United States Patent [19]

Dixon

[11] 3,951,125

[45] Apr. 20, 1976

[54] FOOTBALL PASSER

[75] Inventor: Jack R. Dixon, Miami, Okla.

[73] Assignee: Indian Head Inc., New York, N.Y.

[22] Filed: Sept. 23, 1974

[21] Appl. No.: 508,348

[52] U.S. Cl. ..... 124/8; 273/55 R; 124/41 R; 124/36

[51] Int. Cl.[2] ..... F41B 3/04

[58] Field of Search ..... 124/8, 7, 36, 41 R, 124/34, 33, 31; 273/55

[56] References Cited

UNITED STATES PATENTS

| | | | |
|---|---|---|---|
| 840,323 | 1/1907 | Haughawout | 124/8 |
| 2,767,985 | 10/1956 | Maxcey et al. | 124/36 X |
| 2,921,574 | 1/1960 | Saito | 124/29 |
| 2,980,095 | 4/1961 | Hoag | 124/8 |
| 3,213,843 | 10/1965 | Laney | 124/7 |
| 3,244,132 | 4/1966 | Leichner et al. | 124/8 |
| 3,254,639 | 6/1966 | Laird | 124/7 |
| 3,420,219 | 1/1969 | Raaberger | 124/7 X |

FOREIGN PATENTS OR APPLICATIONS

| | | | |
|---|---|---|---|
| 477,810 | 1953 | Italy | 124/22 X |

*Primary Examiner*—Richard C. Pinkham
*Assistant Examiner*—William R. Browne
*Attorney, Agent, or Firm*—Brumbaugh, Graves, Donohue & Raymond

[57] ABSTRACT

One end of a throwing arm that is pivotally mounted on a frame and is equipped at one end with a football holder. Two propulsion springs are attached to the other end of the throwing arm and extend to a cocking arm that is also pivotally mounted on the frame. The common pivot axis for the two arms is located adjacent to one end of the cocking arm and between the ends of the throwing arm adjacent the springs. In operation, the throwing arm is latched in a "ready-to-throw" position generally parallel to the intended direction of flight of the football. The cocking arm is pivoted into and latched in a position in which the springs are extended so as to exert a biasing force on the throwing arm. The throwing arm is released and the springs pivot the throwing arm and the ball holder forwardly in an arc. The football is propelled from the ball holder by the centrifugal and tangential forces imparted by the pivotal motion of the holder, without any impact that arrests movement of the holder.

19 Claims, 5 Drawing Figures

FOOTBALL PASSER

BACKGROUND OF THE INVENTION

In my copending United States patent application Ser. No. 404,497, filed Oct. 9, 1973, I have described and illustrated two embodiments of a football passer capable of throwing a football in a spiraled pass after a selected time delay. The football passer is constructed so that its throwing arm simulates the natural action of a quarterback and "follows through" after the football is released from the ball holder of the passer, rather than being stopped short. A timer-trigger device permits a player to arm the football passer, select a time delay period after which the football will be thrown, and then go out for a pass. The timer-trigger thus permits individual practice in pass reception and related maneuvers, such as defensive coverage of a pass receiver, without requiring a quarterback.

The throwing arm of each illustrated embodiment of the football passer of my previous application has to be drawn back into a "ready-to-throw" or cocked position against the biasing action of the coil springs that provide propulsion for the throwing arm. In addition, the timer-trigger device is actuated by manually and forcibly spinning a pair of weighted knobs attached to a rotatable rod.

SUMMARY OF THE INVENTION

The present invention is directed to a football passer that embodies certain improvements in its throwing operation. Specifically, the passer incorporates a pivotable cocking arm, to which the propulsion springs of the passer are attached, so that the throwing arm of the passer may be latched in its "ready-to-throw" or cocked position without having simultaneously to extend the propulsion springs. The springs are subsequently extended, in preparation for propelling the throwing arm, by a separate rotational movement of the cocking arm. Such a construction facilitates the operation of the passer, particularly in embodiments equipped with a safety shield for the throwing arm. A safety shield restricts access to the throwing arm and, consequently, makes it difficult to grasp and cock the throwing arm. The passer of the present invention also includes cerain improvements in the trigger device, which tend to eliminate some of the possible human errors in selecting a time delay period. In one embodiment, the trigger device utilizes considerably fewer components than the timer-trigger device of my copending application.

A football passer, according to the present invention, comprises a frame and a throwing arm mounted on the frame for pivotal movement. The throwing arm has a football holder adjacent one end and a pair of springs attached to its other end to provide propulsion for rotating the throwing arm. The throwing arm pivots about an axis located between the ends of the arm but adjacent the end to which the springs are attached. A cocking arm is also mounted adjacent one end on the frame for pivotal movement about the pivot axis of the throwing arm. The propulsion springs for the throwing arm extend from the end of the throwing arm to a part of the cocking arm spaced from the pivot axis.

In operation, the throwing arm is rotated into a position generally parallel to the intended direction of flight of the football and is releasably coupled to the frame by a trigger device. Since the throwing arm is connected with the cocking arm by the propulsion springs, the cocking arm follows the movement of the throwing arm so that the two arms are in substantial alignment. To arm the passer, the cocking arm is rotated in a direction opposite that in which the throwing arm was rotated and is latched to the frame of the football passer in a position in which the propulsion springs are substantially extended and tend to rotate the throwing arm into an equilibrium position with the cocking arm. The trigger device is then actuated to release the throwing arm which pivots forward and moves the football holder in an arc so as to impart centrifugal and tangential forces to the football and propel the football from the holder without an impact that arrests movement of the holder.

In order to enable the operator of the football passer to practice maneuvers individually and, specifically, to allow the operator to go out for a pass, the trigger device for the throwing arm incorporates a time delay feature. In one embodiment, the trigger device includes a strip of flexible and resiliently compressible material of a predetermined thickness attached at one end to the throwing arm. A bracket is mounted on the frame of the football passer and has a slot or notch formed in it with a width no greater than the thickness of the strip.

To restrain the throwing arm in its cocked position, the flexible strip is pressed into the slot in the bracket so as to hold the throwing arm frictionally on the frame. When the passer is armed by extending the propulsion springs, the biasing action of the springs tends to pull the strip through the slot in the bracket to release the throwing arm from the frame. The frictional drag resulting from drawing the strip through the relatively narrow slot results in a time delay before the throwing arm is released. The time delay can be varied by selecting the point along the length of the flexible strip at which the strip engages the bracket. In addition, the bracket may be rotatably mounted on the frame of the passer so that the orientation of the slot relative to the strip can be varied. Thus, when it is in the slot, the strip is crimped to a greater or lesser extent, depending on the position of the bracket, and the delay before the throwing arm is released is varied accordingly.

In another embodiment, the trigger device includes a catch attached at one end to the throwing arm and engageable with an end of a latch bar pivotally mounted intermediate its ends on the frame. A bellows is attached to the other end of the latch bar and is mounted on the frame so that pivotal movement of the latch bar tends to compress or extend the bellows. A release member holds the latch bar against pivotal movement.

In operation, the release member is engaged with the latch bar to hold the bar in a position in which the bellows is fully extended. The throwing arm is drawn back into its cocked position and the catch engages the latch bar. To fire the passer, the release member is depressed so as to release the latch bar for pivotal movement in response to the biasing action exerted by the propulsion springs on the throwing arm. The latch bar pivots against the resistance of the bellows, which provides a time delay, until the bar pivots beyond a selected position and the catch slips out of engagement with the latch bar. The angular orientation between the catch and the throwing arm may be varied so that the extent of engagement between the catch and the latch bar is varied and the time delay is correspondingly varied.

BRIEF DESCRIPTION OF THE DRAWINGS

For a better understanding of the invention, reference may be made to the following description of an exemplary embodiment, taken in conjunction with the figures of the accompanying drawings, in which.

DESCRIPTION OF AN EMBODIMENT

Figure 1:
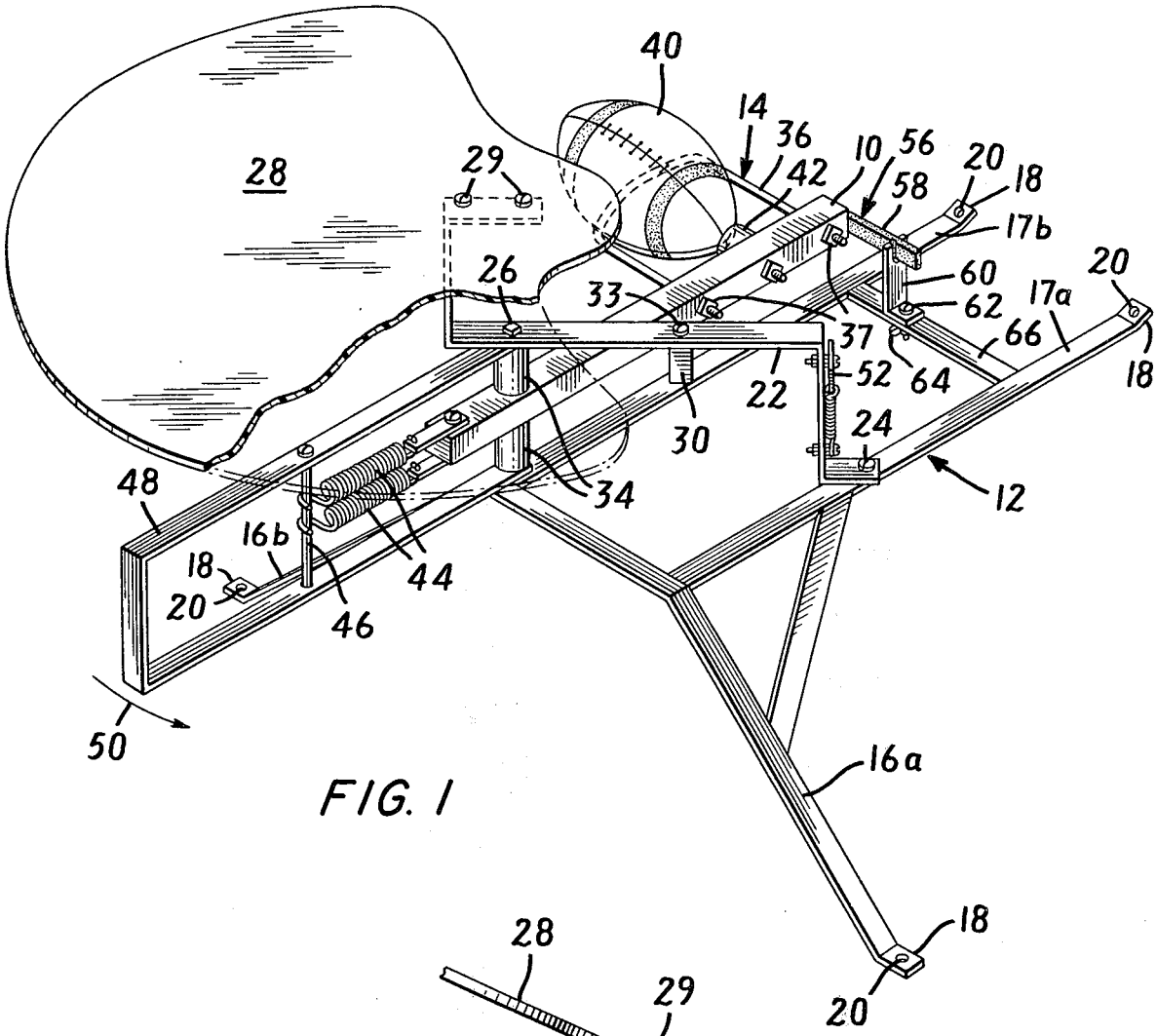
FIG. 1 is a perspective view of a football passer constructed according to the invention.
Figure 3:
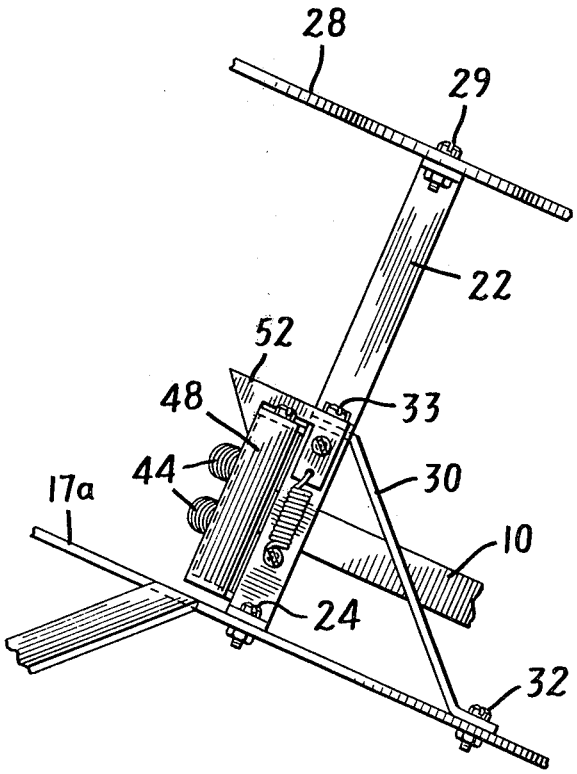
FIG. 3 is an enlarged partial side view of the football passer of FIG. 1, taken along view line 3—3 in FIG. 2.
Figure 2:
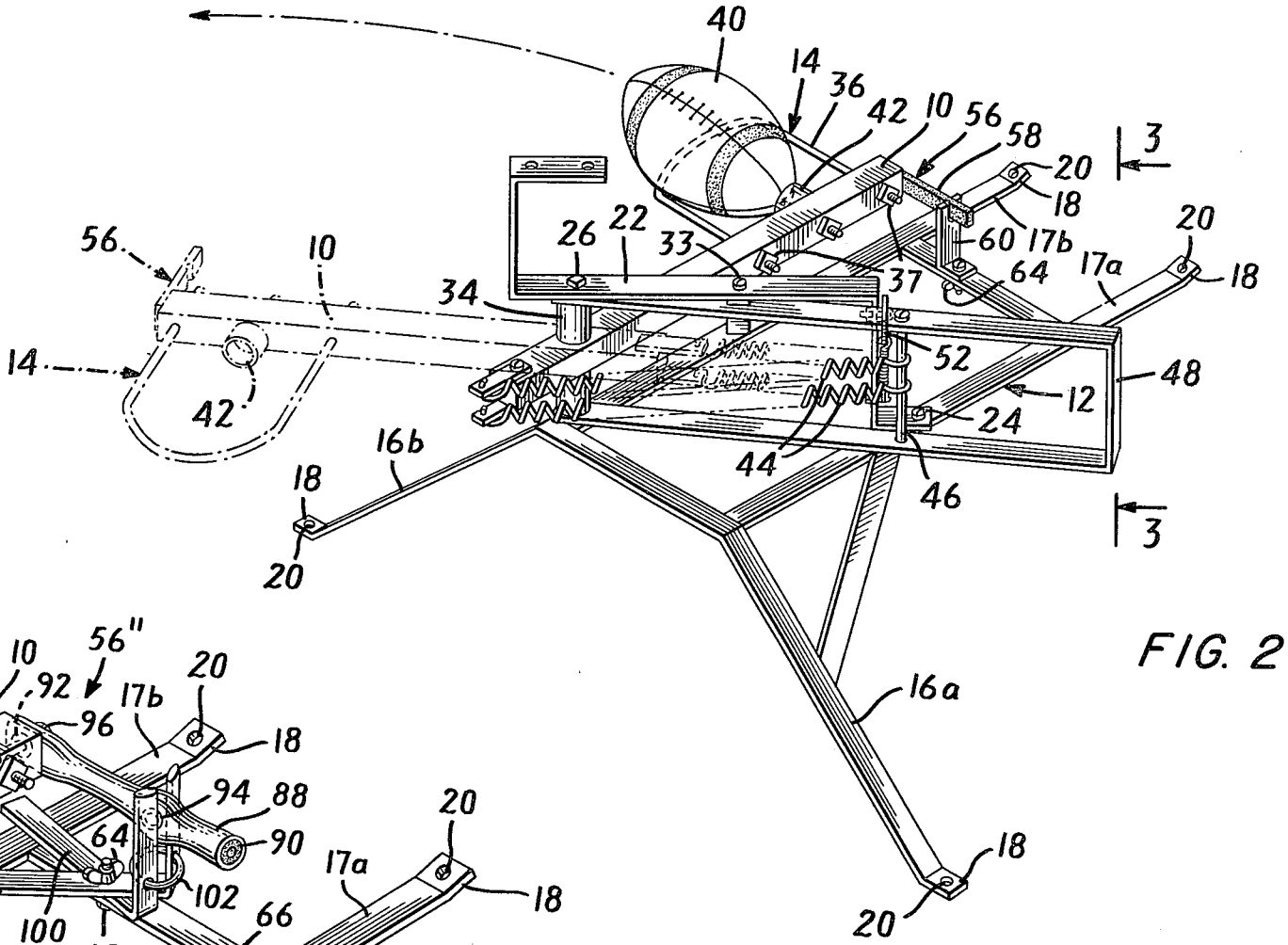
FIG. 2 is a second perspective view of the football passer of FIG. 1.

In an exemplary embodiment of the invention, as illustrated in FIGS. 1–3, a football passer comprises an elongated wooden throwing arm 10, pivotally mounted adjacent one end on a steel frame, generally designated 12. At the other end of the throwing arm 10 is a football holder 14, which includes a specially configured member 36 fabricated of metal rod. The frame 12 includes a pair of bipods that are coupled together and are aligned in the general direction of throw. The bipods have legs of unequal length and the shorter leg 16*a*, 16*b* of each bipod is aligned in front of the longer leg 17*a*, 17*b*. The passer is inclined, therefore, upwardly from rear to front at an angle to the horizontal. The longer legs 17*a*, 17*b* of the bipods are generally parallel but the shorter legs 16*a*, 16*b* are angled not only downward from the longer legs but also away from each other to enhance the stability of the passer. The tip 18 of each leg 16*a*–17*b* is bent at an angle from the rest of the leg to define a foot which rests generally flat on the ground. A small hole 20 formed in each leg 16*a*–17*b* near the tip 18 permits a metal pin or spike (not shown) to be driven through the hole and into the ground to give added stability to the passer. The two bipods may be joined together in any convenient manner. In the illustrated embodiment of the passer, the two shorter legs 16*a*, 16*b* of the bipods are formed of a single, appropriately configured flat steel strip.

Mounted on the longer legs 17*a*, 17*b* of the bipods is a steel throwing arm support 22. As viewed from the rear of the passer, the throwing arm support 22 is attached to the middle of the longer leg 17*a* of the left-hand bipod by a bolt 24 that passes through aligned holes in the throwing arm support and the bipod leg. The throwing arm support 22 extends generally vertically above the bipod leg 17*a* and then generally horizontally across to the front of the longer leg 17*b* of the right-hand bipod. A clevis pin 26 extends through aligned holes in the throwing arm support 22 and the longer leg 17*b* of the right-hand bipod and is held against axial movement by an enlarged head at one end and a cotter pin (not shown) at its other end. The clevis pin 26 acts as the pivot axis for the throwing arm 10, as will be described hereinafter.

After extending horizontally for a short distance beyond the clevis pin 26, the throwing arm support 22 again extends vertically upward and then doubles back on itself in a generally horizontal plane to present a U-shaped configuration. The uppermost horizontal portion of the throwing arm support 22 mounts a Masonite cover guard or safety shield 28 that restricts access to the throwing arm 10. The cover guard 28 is secured to the throwing arm support 22 by a pair of bolts 29 that extend through aligned holes in the cover guard and the support.

To give added stability to the throwing arm support 22, a brace 30 extends from a point intermediate the ends of the longer leg 17*b* of the right-hand bipod to a point on the support intermediate the bolt 24 and the clevis pin 26. The brace 30 is attached to the bipod leg 17*b* and the throwing arm support 22, respectively, by bolts 32 and 33. Because of the angular alignment of the throwing arm support 22 and the bipod legs, the brace 30 is oriented at an angle to the bipod leg 17*b*.

As indicated above, the wooden throwing arm 10 is pivotally mounted adjacent one end on the frame 12 by the clevis pin 26, which extends through aligned openings in the throwing arm support, the throwing arm 10, and the longer leg 17*b* of the right-hand bipod. To position the throwing arm 10 on the clevis pin 26 intermediate the throwing arm support 22 and the longer leg 17*b* of the right-hand bipod, a pair of cylindrical wooden spacer blocks 34 are also mounted on the clevis pin 26, one above and one below the throwing arm.

The football holder 14 is mounted at the free end of the throwing arm 10 and, as previously described, the main element of the holder 14 is a specially configured member 36 fabricated of tempered steel wire of ⅛ inch diameter, for example. The wire member 36 has a U-shaped configuration including a pair of legs joined by a curved connecting portion. The free ends of the legs of the U-shaped wire member 36 are threaded and pass through bores drilled in the wooden throwing arm 10. Washers (not shown) and nuts 37 that are threaded onto the free ends of the legs of the wire member 36 hold the member on the throwing arm 10. The curved portion of the U-shaped member 36 is bent downwardly from the remainder of the member at approximately at 45° angle to support the forward half of a football 40, when it is placed in the holder 14. The rear end of the football 40 is supported by a plastic, cup-shaped bracket 42 bolted to the throwing arm 10 at a point intermediate the free ends of the legs of the U-shaped wire member 36. The rear bracket 42 pushes the football 40 during forward rotational movement of the throwing arm 10.

The throwing arm 10 and the ball holder 14 are pivoted in a forward arc by two identical coil springs 44 that are each attached at one end to the throwing arm 10 near its pivot axis (i.e., near the clevis pin 26) and at the other end to a second clevis pin 46 mounted on a cocking arm 48. The point at which the two springs 44 are attached to the throwing arm 10 is closer to the end of the throwing arm than the pivot axis, as represented by the clevis pin 26, in order to facilitate the operation of the cocking arm 48, as will become apparent hereinafter.

The cocking arm 48 comprises a generally U-shaped strip of flat steel with aligned holes at its ends for mounting the arm on the clevis pin 26. When mounted on the clevis pin 26, the two legs of the U-shaped cocking arm 48 are disposed one between a spacer block 34 and the throwing arm support 22 and the other between the second spacer block 34 and the longer leg 17*b* of the right-hand bipod, respectively. The clevis pin 46, to which the ends of the springs 44 are attached, extends between the two legs of the cocking arm 48 intermediate the ends of the arm. Since both the throwing arm 10 and the cocking arm 48 are pivotable about the same axis and since they are interconnected by the springs 44, the springs 44 exert a biasing action on the two arms which tends to keep the arms in longitudinal alignment. The free end of the cocking arm 48 extends beyond the edge of the safety shield 28 so that the end of the arm can be conveniently grasped by the operator of the passer to cock the arm.

In a typical throwing operation, the football 40 is placed in the football holder 14 and the throwing arm 10 is cocked and restrained in a position generally parallel to the intended direction of flight and adjacent the longer leg 17*b* of the right-hand bipod of the frame 12. As illustrated in FIG. 1, the springs 44 maintain the cocking arm 48 in longitudinal alignment with the throwing arm during the cocking of the throwing arm. The cocking arm 48 is then grasped at its end opposite its pivot axis and is rotated in a direction, indicated by the arrow 50 in FIG. 1, opposite the direction in which the throwing arm 10 is rotated to cock the throwing arm. The rotational movement of the cocking arm 48 tends to extend the springs 44, as indicated in full in FIG. 2. The cocking arm 48 is held in a predetermined cocked position relative to the frame 12 and the throwing arm 10 by a spring loaded latch 52. The latch 52 is rotatably mounted on the vertically extending portion of the throwing arm support 22 adjacent the longer leg 17*a* of the left-hand bipod of the frame 12. As best illustrated in FIG. 3, the latch 52 is configured to engage the top of the cocking arm 48. With the springs 44 extended and the throwing arm 10 and the cocking arm 48 no longer in an equilibrium relationship, the springs 44 tend to urge the throwing arm 10 and the football 40 into a forward pivotal movement, as indicated by the dot-dash line in FIG. 2, when the throwing arm is released from its position alongside the bipod leg 17*b*. As the throwing arm 10 pivots and the ball holder 14 moves in an arc, the centrifugal and tangential forces exerted on the ball 40 in the holder force the ball to roll over the edge of the U-shaped wire member 36 and out of the holder in a forward spiraling movement.

Unlike many conventional throwing devices, the passer does not require an arresting impact that quickly stops the forward movement of the throwing arm 10 in order to hurl the football 40. Rather, the throwing arm 10 pivots well beyond the point at which the football 40 is propelled from the holder 14 in a "follow-through" action. The arm 10 is ultimately slowed down and returned to an equilibrium position in alignment with the cocking arm 48 by the springs 44.

The football passer of the invention becomes "automatic" in operation by the inclusion of a timing feature in the trigger mechanism 56 that holds the throwing arm 10 in its "ready-to-throw" or cocked position. In the embodiment of FIGS. 1–3, the trigger mechanism 56 includes a flexible and resiliently compressible strip of material 58, such as rubber, atttached at one end to the end of the throwing arm 10 which mounts the ball holder 14. An L-shaped bracket 60 is mounted with a bolt 62 and a butterfly nut 64 on a cross-brace 66 extending between the longer legs 17*a*, 17*b* of the frame bipods. The upstanding leg of the L-shaped bracket 60 is slotted or notched at its end to receive the free end of the flexible strip 58. The slot or notch in the bracket 60 is no wider, and preferably somewhat narrower, than the thickness of the strip 58 so that the strip fits tightly in the slot. For convenience in initially pressing the strip 58 into the slot, a notch may be formed in the resilient strip 58, as illustrated in the drawings. The friction between the resilient strip 58 and the bracket 60 tends to hold the throwing arm 10 in its cocked position parallel to the longer bipod legs 17*a*, 17*b*.

When the cocking arm 48 is cocked, the biasing action of the springs 44 tends to pull the resilient strip 58 through the slot to release the throwing arm 10. The resilient strip 58 and the slot in the bracket 60 are dimensioned and fabricated so that a certain delay elapses from the time that the springs 44 begin to pull the strip through the slot and the time at which the throwing arm 10 is ultimately released to throw the ball 40. The length of the time delay period may be varied by varying the length of the resilient strip 58 that must be pulled through the slot in the bracket 60 and/or the bracket 60 may be rotated on the frame brace 66 after loosening the wing nut 64. With the bracket 60 rotated so that the slot in the bracket and the flexible strip 58 are not aligned when the throwing arm is rotated into its cocked position, the flexible strip must be crimped or bent in order to press it into the slot in the bracket 60. Crimping the flexible strip tends to lengthen the time delay period before the throwing arm 10 is released.

Figure 4:
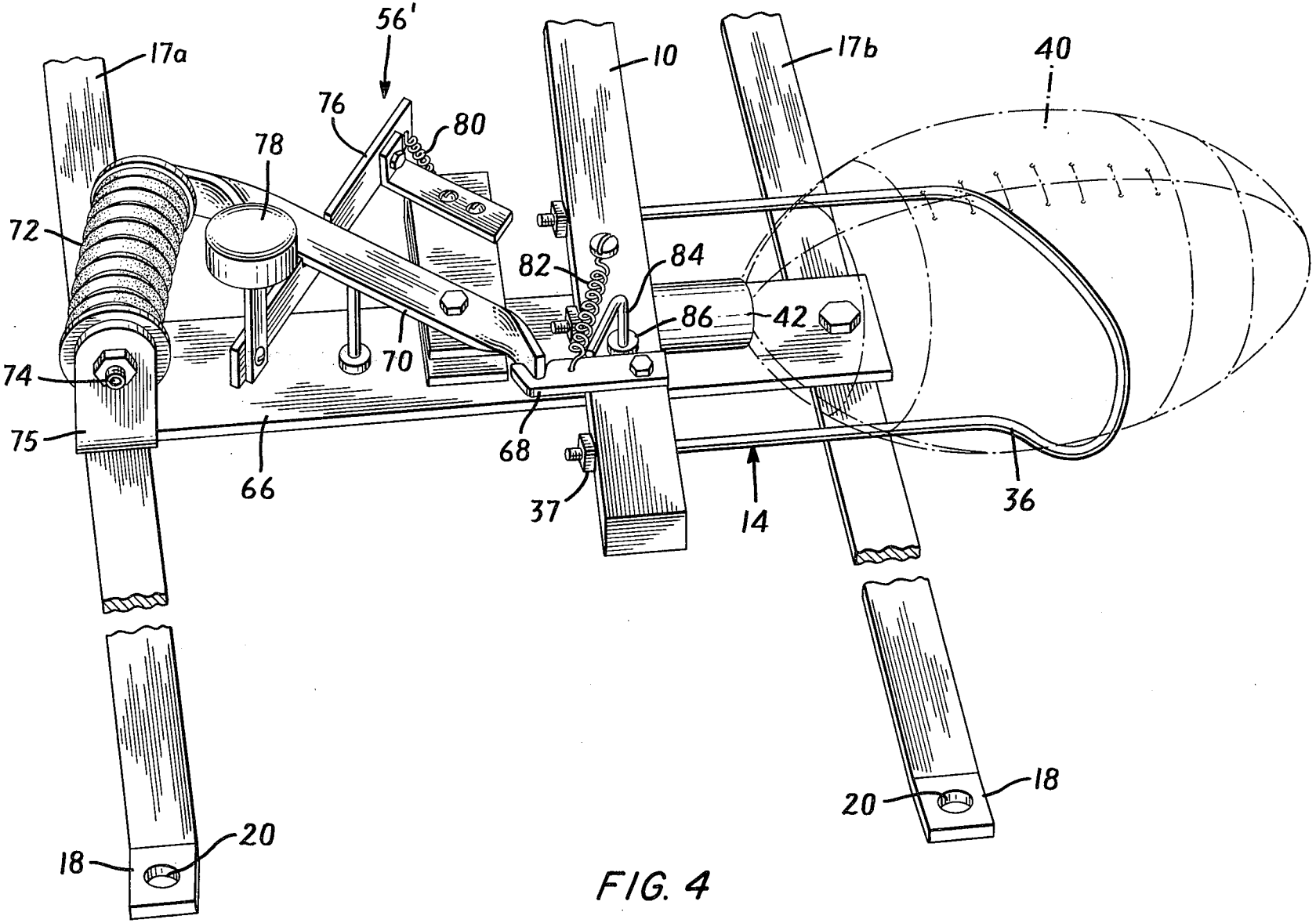
FIG. 4 is a perspective view of a second embodiment of a trigger device for a football passer according to the invention.

FIG. 4 of the drawings illustrates an alternate embodiment of a trigger device that can be used in the football passer of the present invention. In the trigger device 56' of FIG. 4, a catch 68 is mounted at one end adjacent the free end of the throwing arm 10. The free end of the catch 68 is notched to facilitate engagement with one end of a latch bar 70 that is pivotally mounted at a point between its ends on the cross-brace 66 for the frame 12. The other end of the latch bar 70 is bolted to a bellows element 72. The bellows element 72 is fabricated essentially of corrugated plastic and is entirely closed except for a tubular projection 74 at one end which is an air inlet and outlet. The end of the bellows that is not connected to the latch bar 70 is mounted on the longer leg 17*a* of the left-hand bipod by a mounting bracket 75 provided with a hole through which the tubular projection 74 of the bellows extends. The latch bar 70 is held against pivotal movement by a spring loaded release member 76. The release member 76 has an actuating knob 78 at one end and is pivoted adjacent its other end with a biasing spring 80 located at its other end beyond the pivot point.

In operation, the latch bar 70 is pivoted into a position in which the bellows member 72 is fully extended. The release member 76, which is biased upwardly by the spring 80, engages the latch bar in a cutout formed in the upper edge of the release member. The throwing arm 10 is then pulled backward and cocked so that the notch formed in the free end of the catch 68 engages the corresponding end of the latch bar 70. When the football passer is to be fired, the actuating knob 78 is depressed so that the release member 76 disengages from the latch bar 70. The biasing action of the extended springs 44 causes the catch 68 to urge the latch bar 70 to pivot against the resistance of the extended bellows element 72. The bellows element 72 compresses slowly because the opening in the tubular projection 74 is relatively small in size and the air in the bellows element escapes at a relatively slow rate. As the latch bar 70 rotates, the engagement between the latch bar and the catch 68 becomes more and more tenuous until the latch bar rotates beyond a point at which the catch 68 disengages from the release bar and the throwing arm 10 rotates forward to throw the football 40.

In order to vary the time delay in the trigger device 56' illustrated in FIG. 4, the free end of the catch 68, which extends generally perpendicularly away from the throwing arm 10, is biased by a spring 82 toward the throwing arm 10. An L-shaped time adjustment lever 84, formed of steel rod, is force-fit into an opening drilled through the top of the throwing arm 10 adjacent the catch 68. The lever 84 acts as a stop to limit the movement of the catch 68 under the biasing action of the spring 80. The time adjustment lever 84 can be rotated relative to the throwing arm 10 but the tightness of the fit tends to hold the adjustment lever in any particular selected position. An eccentric enlargement 86 is formed intermediate the ends of the leg of the lever 84 which is fitted into the throwing arm 10. Thus, as the time adjustment lever 84 is rotated with its eccentric enlargement 86 in contact with the catch 68, the angular orientation between the catch and the longitudinal axis of the throwing arm 10 is selectively varied. This selective variation in the angular orientation of the catch 68 and the throwing arm 10, in turn, affects the extent of the engagement possible between the notch at the free end of the catch and the cooperating end of the latch bar 70. As a result, the position to which the latch bar 70 must rotate, before the catch 68 is disengaged, can be varied to vary the time delay of the trigger device 56'.

Figure 5:
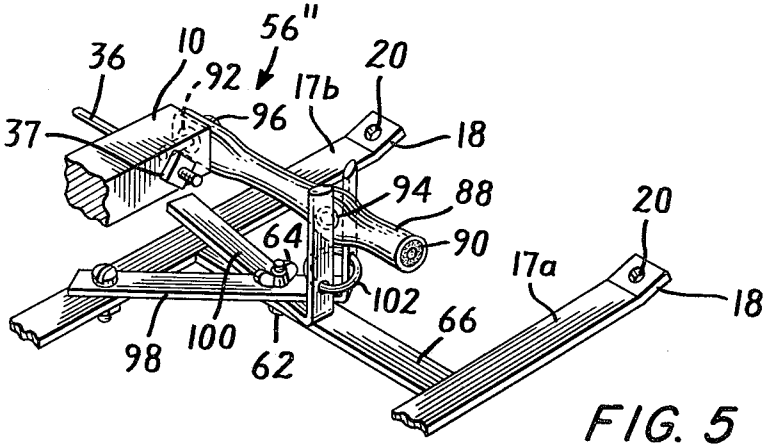
FIG. 5 is a perspective view of a third embodiment of a trigger device for a football passer according to the invention.

FIG. 5 of the drawings shows an embodiment of a trigger device similar to the mechanism 56 of FIG. 2 but constructed to afford a different manner of time delay adjustment. In the trigger device 56'' of FIG. 5, the resilient strip 58 of FIG. 2 is replaced with a flexible, resiliently compressible vinyl tube 88. A tubular rubber insert 90 that is less easily compressed than the tube 88 is placed on one end of the tube and two metal eyes 92 and 94 are fitted through the sides of the tube. Eye 92 is located at the end of the tube 88 away from the rubber insert 90 and receives a screw 96 that secures the tube to the throwing arm 10. Eye 94 is located adjacent to the insert 90 and defines a "notch", in the tube 88, similar to the notch in the resilient strip 58.

In place of the L-shaped bracket 60 of the trigger mechanism 56 of FIG. 2, a pair of L-shaped brackets 98 and 100 are mounted on the frame cross-brace 66 with the bolt 62 and butterfly nut 64. The upstanding legs of the L-shaped brackets 98 and 100 together define a slot to receive the tube 88. One L-shaped bracket 98 is held against pivoting by securing the end of its generally horizontal leg to the longer leg 17*b* of the right-hand frame bipod. The width of the slot defined by the two upstanding legs of the brackets 98 and 100 can be adjusted, however, by loosening the butterfly nut 64 and moving the generally horizontal leg of the bracket 100. A metal ring 102 limits movement of the two upstanding legs away from each other. Variations in the width of the slot produce corresponding variations in the length of the time delay before the tube 88 and the insert 90 are pulled through the slot and the throwing arm 10 is released from its cocked position.

From the above description, it can be seen that the inclusion of a cocking arm having a hand-engageable portion that extends beyond a cover guard for the throwing arm of the football passer of the present invention facilitates the use and operation of the passer. The operator of the football passer can conveniently draw the throwing arm 10 back to its cocked position without having to work against the biasing action of the propulsion springs 44 and without having to worry about possible injuries if the arm 10 should slip from his hands. Nonetheless, it will be appreciated that the illustrated football passer can be operated with the cocking arm 48 left always in its latched or armed position illustrated in FIG. 2. It would also be possible to fix the cocking arm 48 to the frame 12 in the position shown in FIG. 2.

It will be understood that the above described embodiment is merely exemplary and that persons skilled in the art may make many variations and modifications without departing from the spirit and scope of the invention. All such modifications and variations are intended to be within the scope of the invention as defined in the appended claims.

I claim:

1. A football passer comprising a frame, an elongated throwing arm mounted adjacent one end on the frame for pivotal movement about a pivot axis and having adjacent its other end a holder for a football, a movable cocking member mounted on the frame for pivotal movement about said axis adjacent one end and having a hand engageable portion adjacent its other end, tension spring means coupled under tension between said one end of the throwing arm at a location thereon on the opposite side of the pivot axis from the holder and a location on the cocking arm intermediate said pivot axis and said other end thereof such that said spring means tends to position the throwing arm and the cocking member in first predetermined relative positions with the spring means imposing a minimum tension force on the throwing arm and the cocking member, latch means for releasably coupling the cocking member to the frame, and trigger means for releasably coupling the throwing arm to the frame, said latch means and triggr means releasably coupling respectively the cocking member and the throwing arm to the frame in second predetermined relative positions and generating a maximum propulsion force in said spring means acting between the throwing arm and the cocking member upon release of said trigger means and the cocking member being latched, the spring means causes the throwing arm to be driven from said second predetermined relative positions to said first predetermined relative positions in pivotal movement about the pivot axis to move the holder in an arc and to impart centrifugal and tangential forces to a football in the holder and propel a football from the holder without an impact that arrests movement of the holder.

2. A football passer according to claim 1, wherein the cocking member has a U-shaped configuration including a pair of spaced apart legs and a connecting portion joining one end of each leg to the corresponding end of the other leg, the pivot axis of the throwing arm passing through the other ends of both of said legs and the connecting portion of the cocking member defining the hand-engageable portion of said cocking member.

3. A football passer according to claim 1, wherein the trigger means includes (a) an elongated member that is flexible, resiliently compressible and attached at one end to the throwing arm, and (b) bracket means mounted on the frame for engaging the elongated member, the bracket means defining a slot into which the elongated member is adapted to be pressed so as to couple the throwing arm frictionally to the frame, whereby when the latch means is coupling the cocking member to the frame and the elongated member is in the slot, the spring means tends to pull the elongated member through the slot to release the throwing arm from the frame for pivotal movement after a time delay.

4. A football passer according to claim 3, wherein the bracket means includes two bracket members juxtaposed to define between them the slot for receiving the elongated member and mounted on the frame so that at least one of the bracket members is movable relative to the other bracket member, the slot having a width that is selectively variable by moving said at least one bracket member relative to the other bracket member, thereby selectively adjusting the time delay for releasing the throwing arm.

5. A football passer according to claim 1, wherein the football holder includes a U-shaped member having a pair of legs and a curved connecting portion joining one end of each leg to a corresponding end of the other leg, the other ends of both legs being attached to the throwing arm and at least the curved connecting portion of the U-shaped member being inclined at an angle to the remainder of the U-shaped member which lies generally in a plane perpendicular to the pivot axis of the throwing arm.

6. A football passer according to claim 5, wherein the football holder also includes a rear bracket mounted between the legs of the U-shaped member adjacent the other ends of the legs for engaging one nose end of a football and pushing it while the throwing arm is moving from said second predetermined relative positions to said first predetermined relative positions.

7. A football passer according to claim 1, wherein the frame includes a pair of bipods, each having a shorter leg and a longer leg, the shorter legs being positioned forward of the longer legs and the throwing arm being mounted on at least one of the longer legs of the bipods, thereby inclining the pivot axis of the throwing arm at an angle to the vertical.

8. A football passer according to claim 7, wherein the legs of each bipod are fitted with holes to receive spikes that pass through the legs and into the ground to give additional stability to the passer.

9. A football passer according to claim 1, further comprising a cover secured to the frame, the cover being arranged above the throwing arm and the football holder and extending over at least a part of the arc through which the holder is moved.

10. A football passer according to claim 1, wherein the trigger means includes a catch member attached at one end to the throwing arm, a latch bar pivotally mounted intermediate its ends of the frame and adapted at one end to engage the other end of the catch member, and a bellows member mounted at one end on the frame and attached at its other end to the other end of the latch bar, whereby when the latch means is coupling the cocking member to the frame and the latch bar is engaging the catch member, the spring means tends to bias the throwing arm so as to pivot the latch bar against the bellows member and compress the bellows member, the latch bar disengaging the catch member after pivoting beyond a particular position.

11. A football passer according to claim 10, wherein the trigger means also includes a release member mounted on the frame for holding the latch bar against pivotal movement, the release member being movable between a first position in which the release member is adapted to engage and hold the latch bar and a second position in which the latch bar is free to move relative to the release member.

12. A football passer according to claim 10, wherein the other end of the catch member extends away from the throwing arm and the trigger means also includes spring means for biasing the other end of the catch member toward the throwing arm and adjustable stop means for limiting movement of the other end of the catch member toward the throwing arm, the stop means being adjustable to vary selectively the extent to which the other end of the catch member can move toward the throwing arm and thereby to vary the particular position beyond which the latch bar must rotate to disengage the catch member.

13. A football passer comprising:

a. a frame;

b. an elongated throwing arm mounted adjacent one end on the frame for pivotal movement about a pivot axis, said arm having adjacent its other end a holder for a football;

c. propulsion means associated with the throwing arm for pivoting the throwing arm relative to the frame about said pivot axis and moving the holder in an arc to impart centrifugal and tangential forces to a football in the holder and propel a football from the holder without an impact that arrests movement of the holder; and d. trigger means for releasably coupling the throwing arm to the frame in addition to the pivotal mounting of the throwing arm on the frame and for triggering propulsion of the throwing arm after a time delay, the trigger means including:

i. an elongated member that is flexible, resiliently compressible and attached at one end to the throwing arm, and ii. bracket means mounted on the frame for engaging the elongated member, the bracket means defining a slot into which the elongated member is adapted to be pressed so as to couple the throwing arm frictionally to the frame, the propulsion means being adated to pull the elongated member through the slot to release the throwing arm from the frame for pivotal movement after said time delay.

14. A football passer according to claim 13, wherein the bracket means includes two bracket members juxtaposed to define between them the slot for receiving the elongated member and mounted on the frame so that at least one of the bracket members is movable relative to the other bracket member, the slot having a width that is selectively variable by moving said at least one bracket member relative to the other bracket member, thereby selectively adjusting the time delay for releasing the throwing arm.

15. A football passer according to claim 13, wherein the elongated member includes a strip of material having a predetermined thickness and the bracket means includes a bracket member having said slot formed therein, width of the slot being no greater than the thickness of the strip and the strip being adapted to be pressed into said slot.

16. A football passer according to claim 15, wherein the bracket is rotatably mounted on the frame for selective variation of the configuration of the strip when the strip is in the slot, thereby selectively to adjust the time delay after which the throwing arm is released.

17. A football passer comprising:

a. a frame;

b. an elongated throwing arm mounted adjacent one end on the frame for pivotal movement about a pivot axis, said arm having adjacent its other end a holder for a football;

c. propulsion means associated with the throwing arm for pivoting the throwing arm relative to the frame about said pivot axis and moving the holder in an arc to impart centrifugal and tangential forces to a football in the holder and propel a football from the holder without an impact that arrests movement of the holder; and d. trigger means for releasably coupling the throwing arm to the frame and for triggering propulsion of the throwing arm after a time delay, the trigger means including a catch member attached at one end to the throwing arm, a latch bar pivotally mounted intermediate its ends on the frame and adapted at one end to engage the other end of the catch member, and a bellows member mounted at one end on the frame and attached at its other end to the other end of the latch bar, whereby when the latch bar is engaging the catch member, the propulsion means is adapted to bias the throwing arm so as to pivot the latch bar against bellows member and compress the bellows member, the latch bar disengaging from the catch member after pivoting beyond a particular position.

18. A football passer according to claim 17, wherein the trigger means also includes a release member mounted on the frame for holding the latch bar against pivotal movement, the release member being movable between a first position in which the release member is adapted to engage and hold the latch bar and a second position in which the latch bar is free to move relative to the release member.

19. A football passer according to claim 7, wherein the other end of the catch member extends away from the throwing arm and the trigger means also includes spring means for biasing the other end of the catch member toward the throwing arm and adjustable stop means for limiting movement of the other end of the catch member toward the throwing arm, the stop means being adjustable to vary selectively the extent to which the other end of the catch member can move toward the throwing arm and thereby to vary the particular position beyond which the latch bar must rotate to disengage the catch member.

* * * * *

PO-1050
(5/69)

UNITED STATES PATENT OFFICE
CERTIFICATE OF CORRECTION

Patent No. 3,951,125 Dated April 20, 1976

Inventor(s) Jack R. Dixon

It is certified that error appears in the above-identified patent and that said Letters Patent are hereby corrected as shown below:

line 41, "at" should be --a--; Column 5, line 59, "atttached" should be --attached--; Column 8, line 39, "triggr" should be --trigger--; after "respectively" insert comma (,);

Column 9, line 53, "of" should be --on--; Column 10, line 42, "adated" should be --adapted--; line 60, insert "the" after --therein,--; Column 12, line 13, "claim 7" should be --claim 17--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*